US007031919B2

(12) United States Patent
Okutani et al.

(10) Patent No.: US 7,031,919 B2
(45) Date of Patent: Apr. 18, 2006

(54) SPEECH SYNTHESIZING APPARATUS AND METHOD, AND STORAGE MEDIUM THEREFOR

(75) Inventors: Yasuo Okutani, Kawasaki (JP); Masayuki Yamada, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/386,052

(22) Filed: Aug. 30, 1999

(65) Prior Publication Data

US 2003/0125949 A1 Jul. 3, 2003

(30) Foreign Application Priority Data

Aug. 31, 1998 (JP) ..... 10-245951

(51) Int. Cl.
*G10L 13/00* (2006.01)

(52) U.S. Cl. ..... 704/258; 704/266; 704/267

(58) Field of Classification Search ..... 704/258, 704/260, 266–267

See application file for complete search history.

(56) References Cited

U.S. PATENT DOCUMENTS 4,979,216 A 12/1990 Malsheen et al. ..... 381/52
5,740,320 A * 4/1998 Itoh ..... 704/267
5,751,907 A * 5/1998 Moebius et al. ..... 704/267
6,188,984 B1 * 2/2001 Manwaring et al. ..... 704/260

FOREIGN PATENT DOCUMENTS

GB 2313530 A 11/1997
GB 2313530 * 11/1997

OTHER PUBLICATIONS

European Search Report for corresponding European Application 99306925.1–2218 (Feb. 2, 2001).

Hunt A. J. et al. "Unit Selection in a Concatenative Speech Synthesis System Using a Large Speech Database" Atlanta, May 7–10, 1996, New York, IEEE, U.S. vol. CONF. 21, May 7, 1996, pp. 373–376, XP002133444.

Campbell W. N. et al. "Duration, Pitch and Diphones in the CTSR TTS System" Proceedings of the International Conference on Spoken Language Processing (ICSLP), JP, Tokyo, ASJ, Nov. 18, 1990, pp. 825–828, XP000506898.

* cited by examiner

*Primary Examiner*—Richemond Dorvil
*Assistant Examiner*—Angela Armstrong
(74) *Attorney, Agent, or Firm*—Morgan & Finnegan, LLP

(57) ABSTRACT

A speech synthesizing apparatus for synthesizing a speech waveform stores speech data, which is obtained by adding attribute information onto phoneme data, in a database. In accordance with prescribed retrieval conditions, a phoneme retrieval unit retrieves phoneme data from the speech data that has been stored in the database and retains the retrieved results in a retrieved-result storage area. A processing unit for assigning a power penalty and a processing unit for assigning a phoneme-duration penalty assign the penalties, on the basis of power and phoneme duration constituting the attribute information, to a set of phoneme data stored in the retrieved-result storage area. A processing unit for determining typical phoneme data performs sorting on the basis of the assigned penalties and, based upon the stored results, selects phoneme data to be employed in the synthesis of a speech waveform.

25 Claims, 6 Drawing Sheets

SPEECH SYNTHESIZING APPARATUS AND METHOD, AND STORAGE MEDIUM THEREFOR

BACKGROUND OF THE INVENTION

This invention relates to an speech synthesizing apparatus having a database for managing phoneme data, in which the apparatus performs speech synthesis using the phoneme data managed by the database. The invention further relates to a method of synthesizing speech using this apparatus, and to a storage medium storing a program for implementing this method.

A method of speech synthesis which concatenates waveform (which will be referred to as the "Concatenative synthesis method" below) is available in the prior art as a method of synthesizing speech. The Concatenative synthesis method changes prosody with a Pitch synchronous overlap adding method (P-SOLA) which changes prosody by placing pitch waveform units extracted from the original waveform unit in conformity with a desired pitch timing. An advantage of the Concatenative synthesis method is that the synthesized speech obtained is more natural than that provided by a synthesis method based upon parameters. A disadvantage is that the allowable range for the change in prosody is narrow.

Accordingly, sound quality is improved by preparing speech data of a wide variety of variations, selecting these properly and using them. Information such as the phoneme environment (the phoneme that is the object of synthesis or several phonemes including both sides thereof) and the fundamental frequency $F_0$ is used as the criteria for selecting the synthesis unit.

However, the conventional method of synthesizing speech described above involves a number of problems.

By way of example, if a database contains a plurality of items of phoneme data which satisfy a certain phoneme environment and the fundamental frequency $F_0$, the phoneme unit used in synthesis is one phoneme unit (e.g., the phoneme unit that appears in the database first) selected randomly from these items of phoneme data. Since the database is a collection of speech uttered by human beings, all of the phoneme data is not necessarily stable (i.e., not necessarily of good quality). The database may contain phoneme data that is the result of mumbling, a halting voice, slowness of speech or hoarseness. If one item of phoneme data is selected randomly from such a collection of data, naturally there is the possibility that sound quality will decline when synthesized speech is generated.

SUMMARY OF THE INVENTION

Accordingly, an object of the present invention is to provide a speech synthesizing apparatus and method capable of appropriately selecting phoneme data used in speech synthesis and of suppressing any decline in sound quality in speech synthesis, as well as a storage medium storing a program for implementing this method.

According to one aspect of the present invention, the foregoing object is attained by providing a speech synthesizing apparatus comprising: storage means for storing plural items of phoneme data; retrieval means for retrieving phoneme data, in accordance with given retrieval conditions, from the plural items of phoneme data stored in the storage means; penalty assigning means for assigning a penalty that is based upon an attribute value to each item of phoneme data retrieved by the retrieval means; and selection means for selecting, from the phoneme data retrieved by the retrieval means, and based upon the penalty assigned by the penalty assigning means, phoneme data to be employed in synthesis of a speech waveform.

According to another aspect of the present invention, the foregoing object is attained by providing a speech synthesizing method comprising: a storage step of storing plural items of phoneme data; a retrieval step of retrieving phoneme data, in accordance with given search retrieval conditions, from the plural items of phoneme data stored at the storage step; a penalty assigning step of assigning a penalty that is based upon an attribute value to each item of phoneme data retrieved at the retrieval step; and a selection step of selecting, from the phoneme data retrieved at the retrieval step, and based upon the penalty assigned at the penalty assigning step, phoneme data employed in synthesis of a speech waveform.

The present invention further provides a storage medium storing a control program for causing a computer to implement the method of synthesizing speech described above.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE PREFERRED EMBODIMENTS

Preferred embodiments of the present invention will now be described in detail in accordance with the accompanying drawings.

[First Embodiment]

Figure 1:
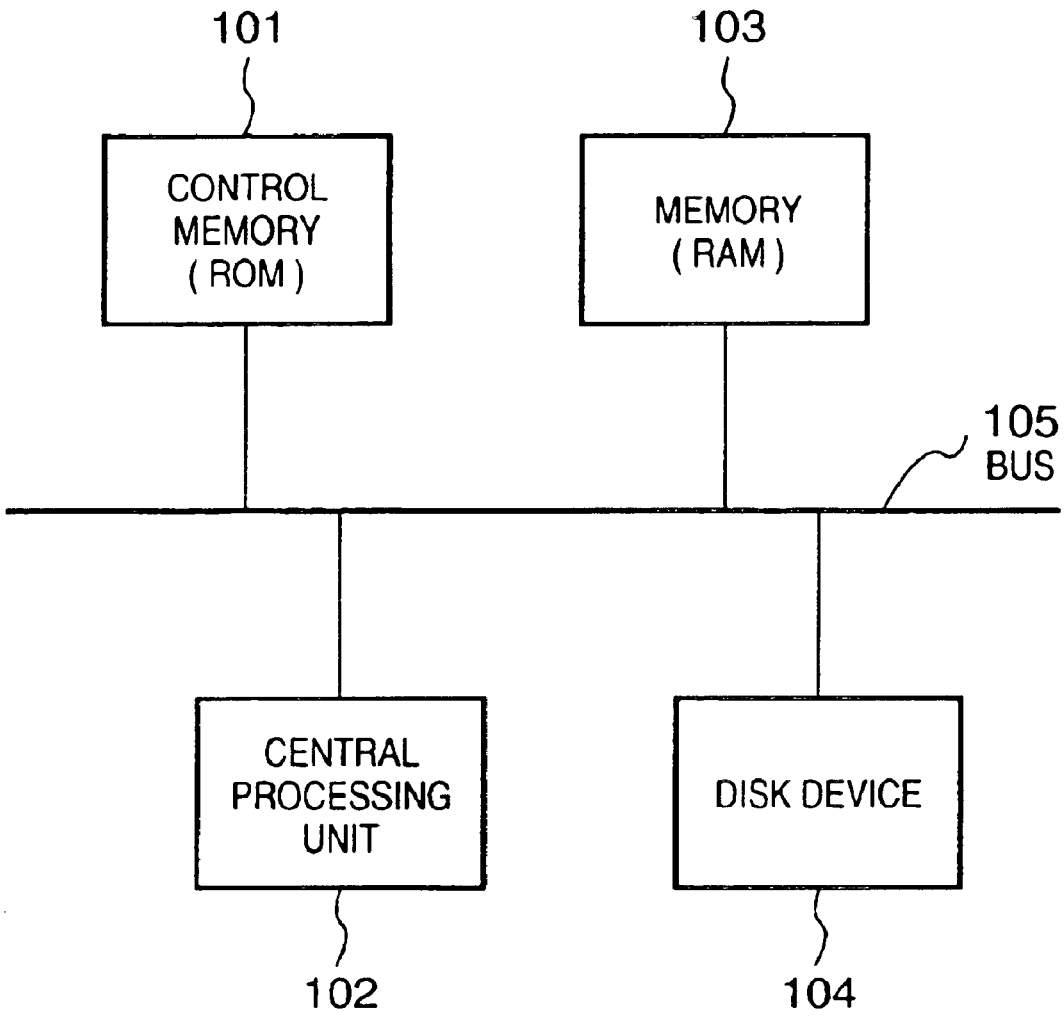
FIG. 1 is a block diagram showing the construction of a speech synthesizing apparatus according to a first embodiment of the present invention.

FIG. 1 is a block diagram illustrating the construction of a speech synthesizing apparatus according to a first embodiment of the present invention.

Figure 2:
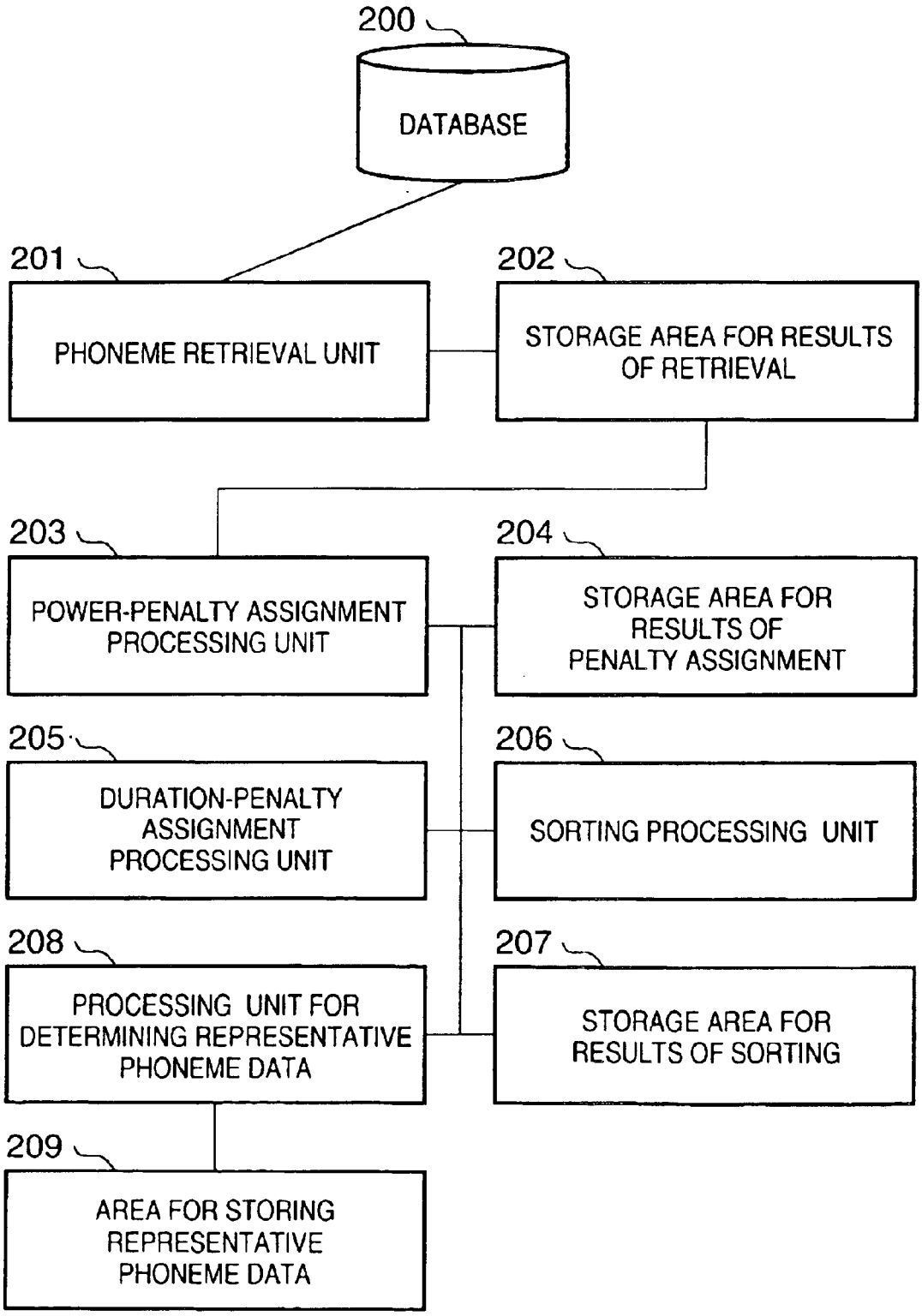
FIG. 2 is a block diagram illustrating functions relating to phoneme data selection processing according to the first embodiment.
Figure 3:
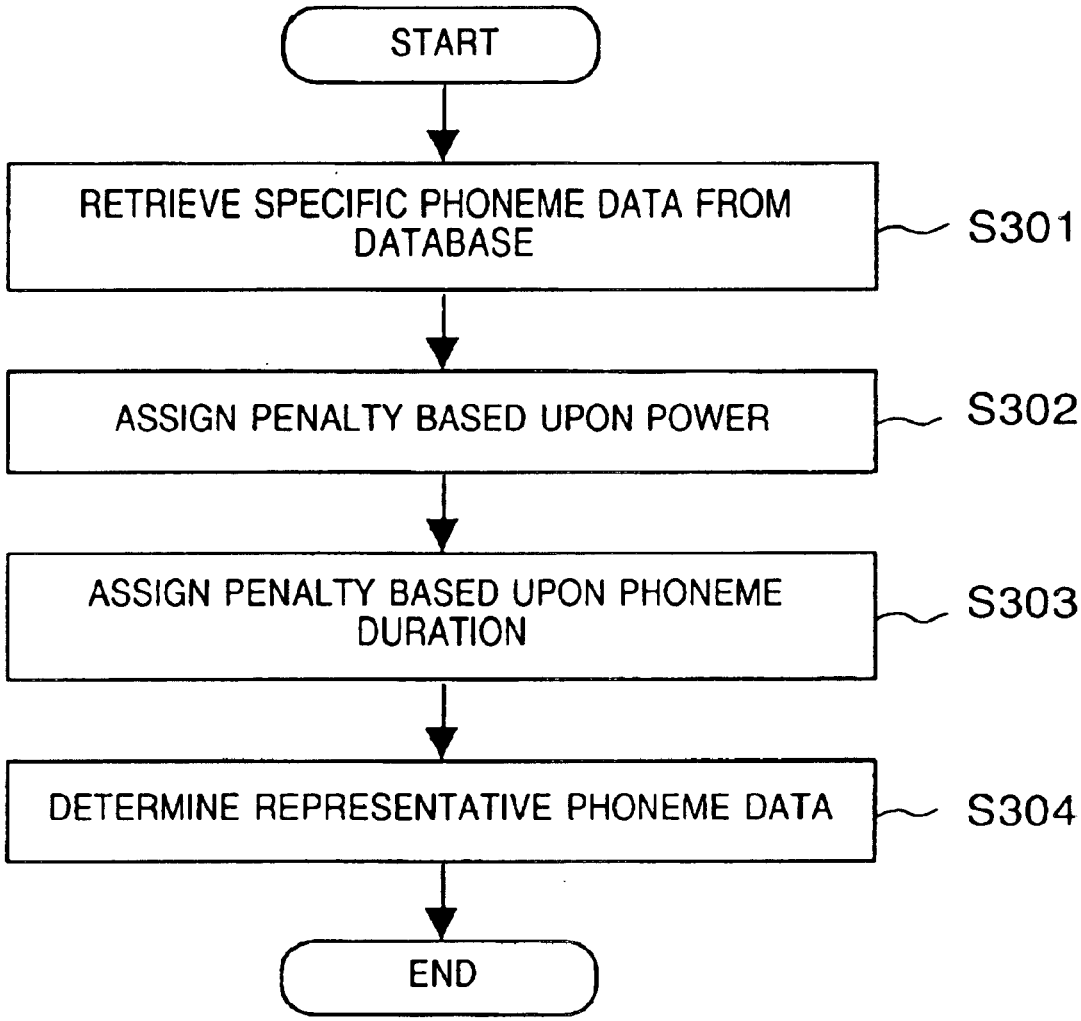
FIG. 3 is a flowchart illustrating a procedure relating to phoneme data selection processing according to the first embodiment.

As shown in FIG. 1, the apparatus includes a control memory (ROM) 101 which stores a control program for causing a computer to implement control in accordance with a control procedure shown in FIG. 3, a central processing unit 102 for executing processing such as decisions and calculations in accordance with the control procedure retained in the control memory 101, and a memory (RAM) 103 which provides a work area for when the central processing unit 102 executes various control operations. Allocated to the memory 103 are an area 202 for holding the results of phoneme retrieval, an area 204 for holding the results of penalty assignment, an area 207 for holding the results of sorting, and an area 209 for holding representative phoneme data. These areas will be described later with reference to FIG. 2. The apparatus further includes a disk device 104 which, in this embodiment, is a hard disk. The disk device 104 stores a database 200 described later with reference to FIG. 2. The data of database 200 is stored in memory 103 when the data is used. A bus 105 connects the components mentioned above.

The speech synthesizing apparatus of this embodiment uses information such as the phoneme environment and fundamental frequency to select the appropriate phoneme data from speech data that has been recorded in the database 200 (FIG. 2) and performs waveform editing synthesis employing the selected data.

Figure 6:
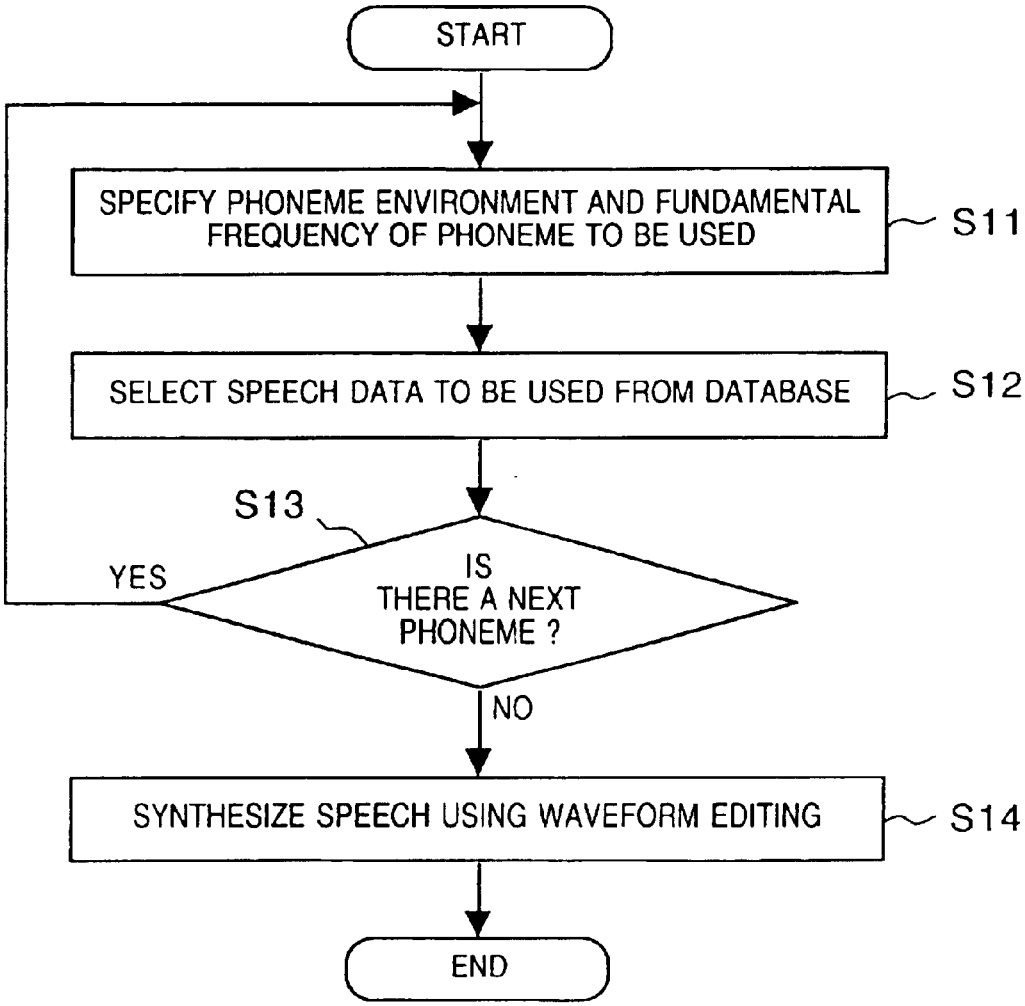
FIG. 6 is a flowchart useful in describing an overview of speech synthesizing processing.

FIG. 6 is a flowchart illustrating an overview of speech synthesizing processing according to this embodiment. The phoneme environment and fundamental frequency of a phoneme to be used are specified at step S11 in FIG. 6. This may be carried out by storing the phoneme environment and fundamental frequency in the disk device 104 as a parameter file or by entering them via a keyboard. Next, at step S12, phoneme data to be used is selected from the database 200. This is followed by step S13, at which it is determined whether phoneme data to be selected exists. Control returns to step S11 if such data exists. If it is determined that all necessary phoneme data has been selected, on the other hand, control proceeds from step S13 to step S14 and speech synthesis by waveform editing is executed using the selected phoneme data.

The details of processing for selecting the phoneme data at step S12 will now be described. In the case described below, selection of phoneme data is carried out using the phoneme environment (three phonemes conposed of the phoneme of interest and one phoneme on each side thereof, these being referred to as a so-called "triphone") and the average fundamental frequency of the phoneme as criteria for selecting phoneme data.

FIG. 2 is a block diagram illustrating functions relating to phoneme data selection processing for selecting the optimum phoneme data from a set of phoneme data in which the phoneme environments and fundamental frequencies are identical. The functions are those of a speech synthesizing apparatus according to the first embodiment.

The database 200 in FIG. 2 stores speech data in which a phoneme environment, phoneme boundary and fundamental frequency, power and phoneme duration are have been assigned to each item of phoneme data. A phoneme retrieval unit 201 retrieves phoneme data, which satisfies a specific phoneme environment and fundamental frequency, from the database 200. The area 202 stores a set of phoneme data, namely the results of retrieval performed by the phoneme retrieval unit 201. A power-penalty assignment processing unit 203 assigns a penalty related to power to each item of phoneme data of the set of phoneme data stored in the area 202. The area 204 holds the results of the assignment of penalties to the phoneme data. A duration-penalty assignment processing unit 205 assigns a penalty relating to phoneme duration to each items of phoneme data.

A sorting processing unit 206 subjects the set of phoneme data to sorting processing regarding specific information (power or phoneme duration, etc.) when a penalty is assigned. The area 207 holds the results of sorting. In regard to the results obtained by assigning penalties, a data determination processing unit 208 selects phoneme data having the smallest penalty as representative phoneme data. The area 209 holds the representative phoneme data that has been decided.

From the speech synthesizing processing set forth above, processing for selecting phoneme data implemented by the above-described functional arrangement will be discussed next. FIG. 3 is a flowchart illustrating a procedure relating to phoneme data selection processing for selecting the optimum phoneme data from the set of phoneme data having identical phoneme environments and fundamental frequencies.

First, at step S301, all phoneme data that satisfies the phoneme environment (triphone) and fundamental frequency $F_0$ that were specified at step S11 is extracted from the database 200 and is stored in area 202. Next, at step S302, the power-penalty assignment processing unit 203 assigns power-related penalties to the set of phoneme data that has been stored in area 202.

The guideline involving power-related penalties is to assign large penalties to phoneme data having power values that depart from an average value of power because the goal is to select phoneme data having an average value of power within the set of phoneme data. The power-penalty assignment processing unit 203 instructs the sorting processing unit 206 to sort the phoneme data set, which has been extracted from the area 202 that holds the results of retrieval, based upon values of power. Power referred to here may be the power of the phoneme data or the average power per unit of time.

The sorting processing unit 206 responds by sorting the phoneme data set based upon power and storing the results in the area 207 that is for retaining the results of sorting. The power-penalty assignment processing unit 203 waits for sorting to end and then assigns a penalty to the sorted phoneme data that has been stored in area 207. A penalty is assigned in accordance with the guideline mentioned above. For example, among items of phoneme data that have been sorted in order of decreasing power, a penalty (e.g., 2.0 points) is added onto phoneme data whose power values fall within the smaller one-third of values and onto phoneme data whose power values fall within the larger one-third of values. In other words, a penalty is assigned to phoneme data other than the middle one-third of phoneme data.

Next, at step S303, the duration-penalty assignment processing unit 205 assigns a penalty relating to phoneme duration through a procedure similar to that of the power-penalty assignment processing unit 203. Specifically, the duration-penalty assignment processing unit 205 instructs the sorting processing unit 206 to perform sorting based upon phoneme duration and stores the results in area 207. On the basis of the sorted results, the duration-penalty assignment processing unit 205 adds a penalty (e.g., 2.0 points) onto phoneme data whose phoneme durations fall within the smaller one-third of durations and onto phoneme data whose phoneme durations fall within the larger one-third of durations. The results obtained by the assignment of the penalty are retained in area 204. Control then proceeds to step S304.

Step S304 calls for the data determination processing unit 208 to determine a representative phoneme unit in terms of the phoneme environment and fundamental frequency currently of interest. Here the set of phoneme data assigned penalty based upon power and phoneme duration, stored in area 204, are delivered delivered to the sorting processing unit 206 and the sorting processing unit 206 is instructed to sort the results by penalty value. The sorting processing unit 206 performs sorting on the basis of the two types of penalties relating to power and phoneme duration (e.g., using the sum of the two penalty values) and stores the sorted results in area 207. When sorting processing ends, the data determination processing unit 208 selects phoneme data having the smallest penalty and stores it in area 209 for the purpose of employing this data as representative phoneme data. If a plurality of phoneme units having the minimum penalty value appear, the data determination processing unit 208 selects the phoneme unit located at the head of the sorted results. This is equivalent to selecting one phoneme unit randomly from those having the smallest penalty.

Thus, in accordance with the first embodiment, the optimum phoneme data is selected, based upon a penalty relating to power and a penalty relating to phoneme duration, from a phoneme data set in which the phoneme environments and fundamental frequencies are identical.

[Second Embodiment]

The first embodiment has been described in regard to a case where the phoneme environment (the "triphone", namely the phoneme of interest and one phoneme on each side thereof) and the average fundamental frequency $F_0$ of the phoneme are used as criteria for selecting phoneme data. However, in instances where the triphone of a combination not contained in the database is required, the need arises to use an alternate "left-phone". (a phoneme environment comprising the phoneme of interest and the phoneme to its left), "right-phone" (a phoneme environment comprising the phoneme of interest and the phoneme to its right) or "phone" (the phoneme of interest alone). In the second embodiment, therefore, there will be described a case where selection of phoneme data other than a specified triphone (such selected phoneme data will be referred to as a "triphone substitute") is taken into account.

Figure 4:
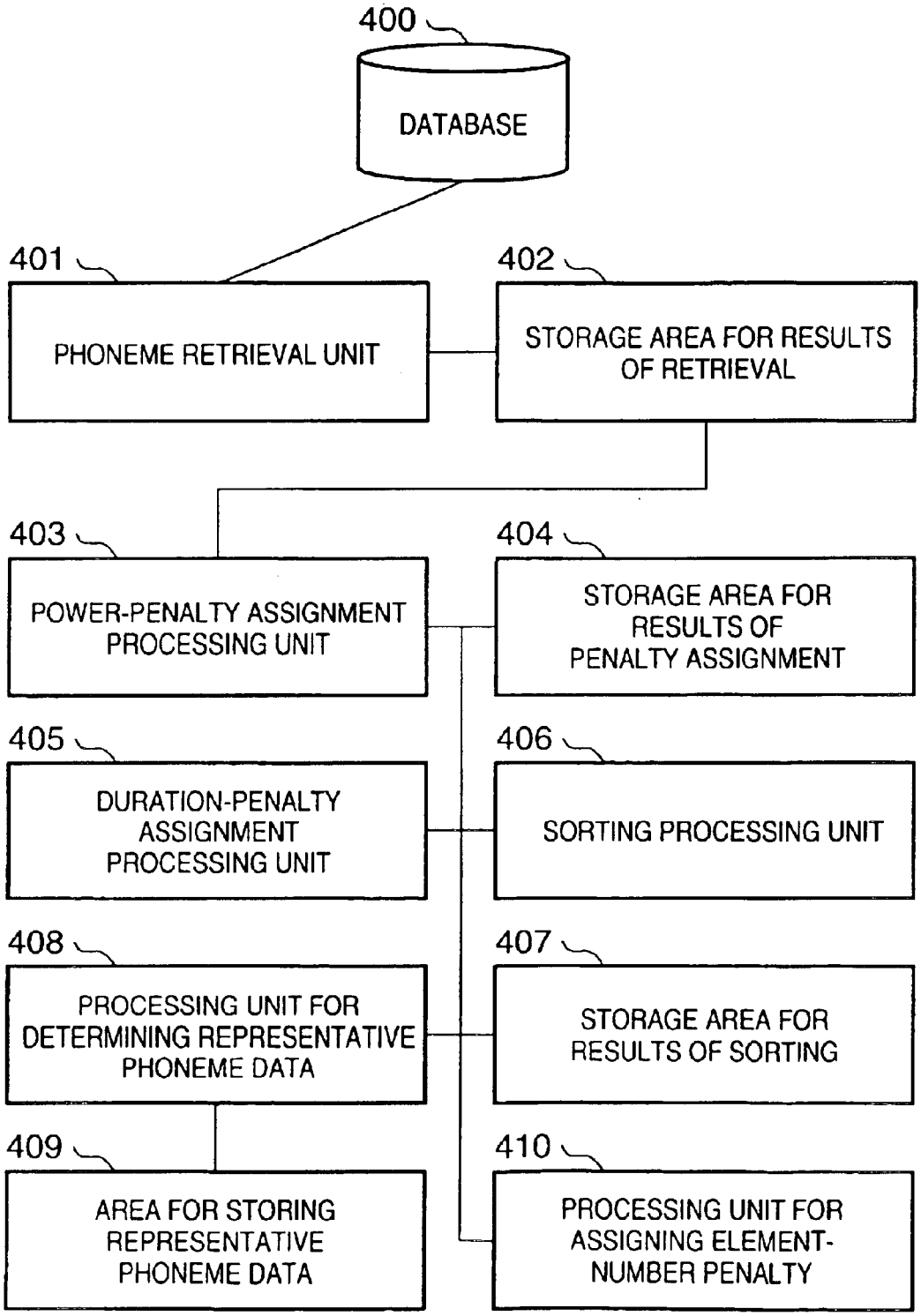
FIG. 4 is a block diagram illustrating functions relating to phoneme data selection processing according to the second embodiment.

FIG. 4 is a block diagram illustrating functions relating to phoneme data selection processing for selecting the optimum phoneme data from a set of phoneme data in which the phoneme environments and fundamental frequencies are identical. The functions are those of a speech synthesizing apparatus according to the second embodiment. This embodiment differs from the first embodiment in FIG. 2 in that the apparatus further includes a processing unit for assigning element-number penalty. Other areas or units 400 to 409 correspond to the areas or units 200 to 209, respectively, of FIG. 2. The processing unit 410 assigns a penalty in dependence upon the number of elements in a set of phoneme data.

Figure 5:
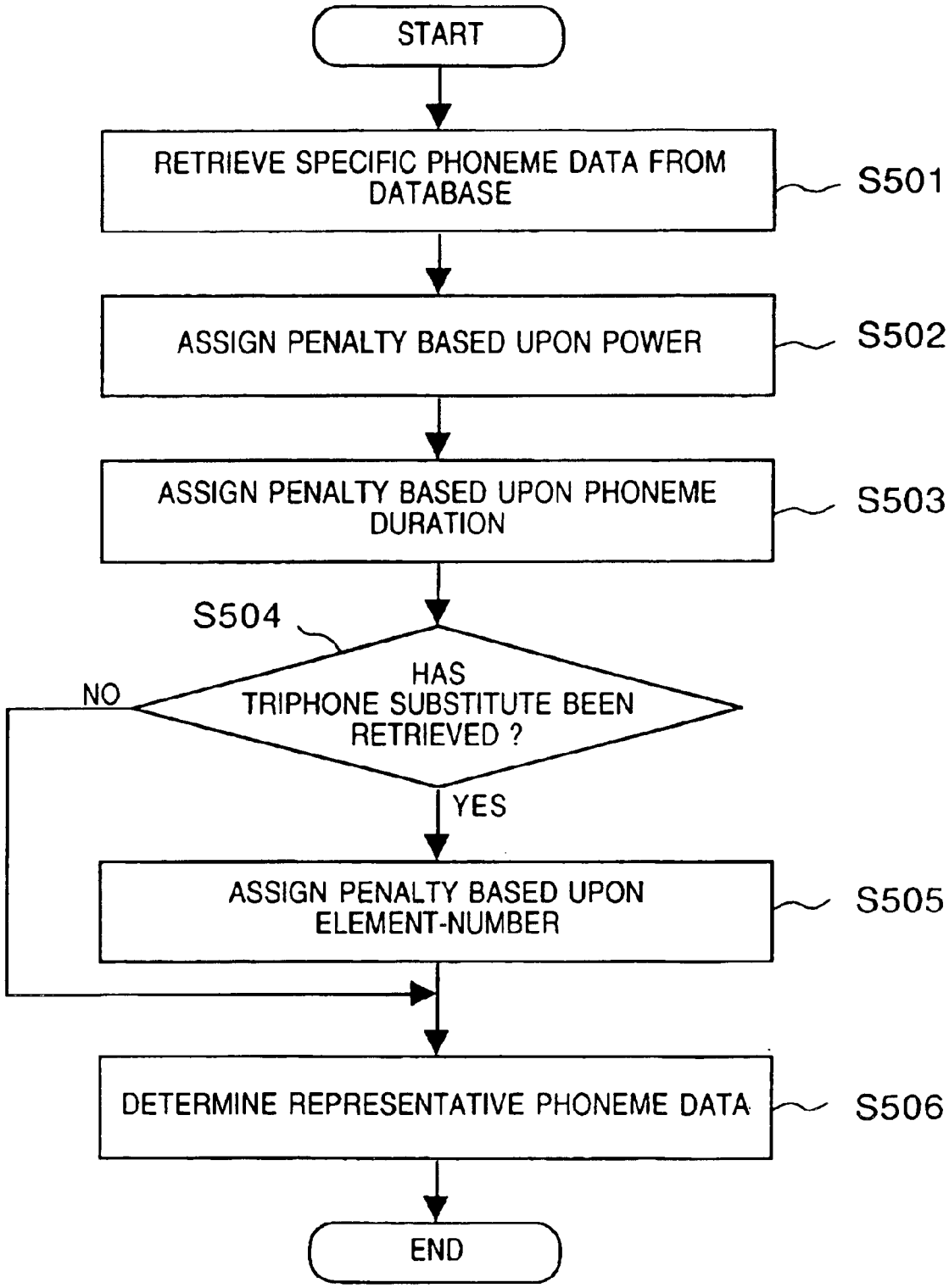
FIG. 5 is a flowchart illustrating a procedure relating to phoneme data selection processing according to the second embodiment.

The speech synthesizing processing includes a procedure relating to phoneme data selection processing, which is implemented by the above-described functional blocks, for selecting optimum phoneme data from a set of phoneme data having identical phoneme environments and fundamental frequencies. This procedure will now be described. FIG. 5 is a flowchart illustrating a procedure according to the second embodiment relating to phoneme data selection processing for selecting the optimum phoneme data from the set of phoneme data having identical phoneme environments and fundamental frequencies.

Steps S501 to S503 are similar to steps S301 to S303 (FIG. 3) in the first embodiment. It should be noted that if a specified triphone does not exist in the database, the triphone retrieval at step S501 involves the retrieval of the alternate candidates left-phone, right-phone or phone (the aforesaid "triphone substitute"). In this case, for example, firstly, retrieval of left-phone is carried out. If the left-phone does not exist in the database, then retrieval of right-phone is carried out. If the right-phone does not exist, then retrieval of phone is carried out. Alternatively, the sequence of retrieval may be different between vowel and consonant. For example, as for vowel, the retrieval is carried out in the sequence of left-phone, right-phone and phone. As for consonant, the retrieval is carried out in the sequence of right-phone, left-phone and phone.

In the second embodiment, use of a triphone substitute means that a specified triphone does not exist. As long as a specified triphone is contained in the database, however, this triphone is adopted. At step S504, therefore, it is determined whether a triphone substitute has been obtained as the result of retrieval. If a triphone substitute has not been obtained, i.e., if the specified triphone has been obtained, control skips step S505 and proceeds to step S506. When the specified triphone is retrieved, therefore, processing similar to that of the first embodiment is executed. If it is determined at step S504 that a triphone substitute has been retrieved, on the other hand, control proceeds to step S505. Here the processing unit 505 assigns a penalty in dependence upon the numbers of elements in the set of phoneme data. In a case where the specified triphone is absent, the processing unit 505 counts the numbers of elements contained in the phoneme data set, the count being performed per each triphone phoneme environment group (a group classified by the environment comprising the phoneme concerned and one phoneme on each side thereof) of the alternate candidate left-phone (or right-phone or phone). In this embodiment, if the number of items of phoneme data of an applicable triphone phoneme environment is small (two or less), then the processing unit 505 adds a penalty (0.5 points) onto all of the phoneme data concerned. In other words, the processing unit 505 judges that data having only a low frequency of appearance in a sufficiently large database is not reliable.

For example, consider a case where a triphone t.A.k does not exist in the database and is to be replaced by a left-phone t.A.*. If two triphones t.A.p and 20 triphones t.A.t exist in the database, allocating a triphone substitute, which is to replace the triphone t.A.k, from among triphones t.A.t of which 20 exist will provided a higher probability of obtaining phoneme data of good quality.

If a penalty based upon number of elements is thus assigned, the result is stored in area 504, which is for holding the results of penalty assignment, and then control proceeds to step S506. Step S506 involves processing equivalent to that of step S304 in the first embodiment. In the second embodiment, a penalty based upon number of elements is assigned in addition to the penalty based upon power and the penalty based upon phoneme duration. As a result, phoneme data is selected upon taking all of these three penalties into consideration. In a case where a specific triphone is retrieved and processing proceeds directly from step S504 to step S506, penalty based upon number of elements is not taken into account.

Thus, in accordance with the second embodiment, it is possible to select the proper phoneme data inclusive of triphones that can be alternates.

In the embodiments set forth above, a case has been described in which penalty assignment processing is executed in order of power penalty and phoneme-duration penalty (and then element-number penalty in the second embodiment). However, this does not impose a limitation upon the present invention, for the processing may be executed in any order. Further, an arrangement may be adopted in which these penalty assignment processing operations are executed concurrently.

Further, in each of the foregoing embodiments, 2.0 points is adopted as the penalty value for the power and phoneme-duration penalties. However, this does not impose a limitation upon the present invention, for it is obvious that a suitable value may be set. In addition, equal penalties need not be applied as the penalties relating to both characteristics.

In the second embodiment, a case in which 0.5 is set as the value of the element-number penalty is described. However, this does not impose a limitation upon the present invention, for a suitable value may be set.

Furthermore, in each of the foregoing embodiments, a case is described in which a penalty is assigned to the one-third of phoneme data starting from smaller values (or to the one-third of phoneme data starting from larger values) in regard to the sorted results. However, this does not impose a limitation upon the present invention. For example, it is possible to change the method of penalty assignment depending upon the number of items of phoneme data or the properties of the phoneme data contained in the database. In such case a penalty may be assigned to data for which the difference relative to an average value is greater than a threshold value.

Further, in the foregoing embodiments, there is described a method of selecting representative phoneme data in which the target is a phoneme data set that satisfies a specific phoneme environment and fundamental frequency. However, this does not impose a limitation upon the present invention. For example, it is possible to use a phoneme data set for which the matter of interest is solely the phoneme environment and to adopt the fundamental frequency as a factor for assigning a penalty.

Further, in each of the above embodiments, there is described a method of selecting a representative phoneme unit on demand, wherein the target is a phoneme data set that satisfies a specific phoneme environment and fundamental frequency. However, an arrangement may be adopted in which a phoneme lexicon obtained by applying the processing of the first embodiment in advance is created based upon all conceivable phoneme environments and fundamental frequencies.

Further, in each of the foregoing embodiments, a case in which the sorting processing unit and the area for holding the sorted results are designed for general-purpose use. However, this does not impose a limitation upon the present invention. For example, an arrangement may be adopted in which there is provided a sorting processor exclusively for the processing unit that assigns the power penalties and a sorting processor exclusively for the processing unit that assigns the phoneme-duration penalties.

In each of the foregoing embodiments, a case in which the areas for storing data are implemented by memory (RAM) is described. However, this does not impose a limitation upon the present invention because any storage media may be used.

Further, in each of the foregoing embodiments, a case in which the components are constituted by the same computer is described. However, this does not impose a limitation upon the present invention because these components may be implemented by computers or processors distributed over a network.

Further, in each of the foregoing embodiments, a case in which a program is stored in a control memory (ROM) is described. However, this does not impose a limitation upon the present invention because the program may be stored in any storage media. The same operations performed by the program may be carried out by circuitry.

The present invention can be applied to a system constituted by a plurality of devices or to an apparatus comprising a single device (e.g., a copier or facsimile machine, etc.).

Furthermore, it goes without saying that the invention is applicable also to a case where the object of the invention is attained by supplying a storage medium storing the program codes of the software for performing the functions of the foregoing embodiment to a system or an apparatus, reading the program codes with a computer (e.g., a CPU or MPU) of the system or apparatus from the storage medium, and then executing the program codes.

In this case, the program codes read from the storage medium implement the novel functions of the invention, and the storage medium storing the program codes constitutes the invention.

Further, the storage medium, such as a floppy disk, hard disk, optical disk, magneto-optical disk, CD-ROM, CD-R, magnetic tape, non-volatile type memory card or ROM can be used to provide the program codes.

Furthermore, besides the case where the aforesaid functions according to the embodiment are implemented by executing the program codes read by a computer, it goes without saying that the present invention covers a case where an operating system or the like running on the computer performs a part of or the entire process in accordance with the designation of program codes and implements the functions according to the embodiments.

It goes without saying that the present invention further covers a case where, after the program codes read from the storage medium are written in a function expansion board inserted into the computer or in a memory provided in a function expansion unit connected to the computer, a CPU or the like contained in the function expansion board or function expansion unit performs a part of or the entire process in accordance with the designation of program codes and implements the function of the above embodiment.

Thus, in accordance with the present invention, as described above, it is possible to provide a speech synthesizing apparatus capable of selecting better phoneme units, as a result of which synthesized speech of superior quality can be produced. The invention provides also a method of controlling this apparatus and a storage unit storing a program for implementing this control method.

As many apparently widely different embodiments of the present invention can be made without departing from the spirit and scope thereof, it is to be understood that the invention is not limited to the specific embodiments thereof except as defined in the appended claims.

What is claimed is:

1. A speech synthesizing apparatus comprising:

storage means for storing plural items of phoneme data;

retrieval means for retrieving phoneme data, in accordance with given retrieval conditions, from the plural items of phoneme data stored in said storage means;

first penalty assigning means for assigning a penalty that is based upon an attribute value to each item of phoneme data retrieved by said retrieval means; and selection means for selecting, from the phoneme data retrieved by said retrieval means, and based upon the penalty assigned by said first penalty assigning means, phoneme data to be employed in synthesis of a speech waveform, wherein the attribute values include power and phoneme duration of each item of phoneme data, and said first penalty assigning means assigns a power-related penalty in such a manner that a small penalty is assigned to phoneme data whose power is close to an average value of the power, and assigns a phoneme-duration-related penalty in such a manner that a small penalty is assigned to phoneme data whose phoneme duration is close to an average value of the phoneme duration.

2. The apparatus according to claim 1, wherein said storage means stores respective items of attribute information together with the plural items of phoneme data, and said first penalty assigning means obtains an attribute value from the attribute information stored in said storage means.

3. The apparatus according to claim 2, wherein the attribute information includes phoneme environment, phoneme boundary, fundamental frequency, power and phoneme duration.

4. The apparatus according to claim 1, wherein said retrieval means retrieval means retrieves phoneme data that satisfies a specified phoneme environment.

5. The apparatus according to claim 1, wherein said retrieval means retrieves phoneme data that satisfies a specified phoneme environment and fundamental frequency.

6. The apparatus according to claim 1, wherein said first penalty assigning means sorts retrieved phoneme data based upon a prescribed attribute value and assigns a penalty value on the basis of order obtained by sorting.

7. A speech synthesizing apparatus comprising:

storage means for storing plural items of phoneme data;

retrieval means for retrieving phoneme data, in accordance with given retrieval conditions, from the plural items of phoneme data stored in said storage means;

first penalty assigning means for assigning a penalty that is based upon an attribute value to each item of phoneme data retrieved by said retrieval means; and selection means for selecting, from the phoneme data retrieved by said retrieval means, and based upon the penalty assigned by said first penalty assigning means, phoneme data to be employed in synthesis of a speech waveform, wherein said first penalty assigning means:

sorts the items of phoneme data in order of decreasing power and assigns a power-related penalty on the basis of the order obtained by sorting, in such a manner that a small penalty is assigned to phoneme data whose power is close to an average value; and sorts the items of phoneme data in order of decreasing phoneme duration and assigns a phoneme-duration-related penalty on the basis of the order obtained by sorting, in such a manner that a small penalty is assigned to phoneme data whose phoneme duration is close to an average value.

8. A speech synthesizing apparatus comprising:

storage means for storing plural items of phoneme data;

retrieval means for retrieving phoneme data, in accordance with given retrieval conditions, from the plural items of phoneme data stored in said storage means;

first penalty assigning means for assigning a penalty that is based upon an attribute value to each item of phoneme data retrieved by said retrieval means;

selection means for selecting, from the phoneme data retrieved by said retrieval means, and based upon the penalty assigned by said first penalty assigning means, phoneme data to be employed in synthesis of a speech waveform;

alternate retrieval means for retrieving phoneme data that satisfies some of the retrieval conditions in said retrieval means does not exist counting means for grouping phoneme data, which has been retrieved by said alternate retrieval means, on the basis of a phoneme environment, and counting the items of phoneme data on a per-group basis; and second penalty assigning means for assigning a penalty on the basis of a count obtained by said counting means to the phoneme data retrieved by said alternate retrieval means, this penalty being assigned in addition to the penalty assigned by said first penalty assigning means.

9. The apparatus according to claim 8, wherein the retrieval conditions include phoneme environment; and said alternate retrieval means retrieves phoneme data which agrees with part of a phoneme environment specified in the retrieval conditions.

10. The apparatus according to claim 9, wherein the phoneme environment specified in the retrieval conditions is a triphone composed of an applicable phoneme and phonemes on both sides thereof; and said alternate retrieval means retrieves phoneme data for which the applicable phoneme and its left side phoneme agree with the retrieval conditions, or phoneme data for which the applicable phoneme and its right side phoneme agree with the retrieval conditions.

11. A speech synthesizing method comprising:

a storage step of storing plural items of phoneme data;

a retrieval step of retrieving phoneme data, in accordance with given search retrieval conditions, from the plural items of phoneme data stored at said storage step;

a first penalty assigning step of assigning a penalty that is based upon an attribute value to each item of phoneme data retrieved at said retrieval step; and a selection step of selecting, from the phoneme data retrieved at said retrieval step, and based upon the penalty assigned at said penalty assigning step, phoneme data employed in synthesis of a speech waveform, wherein the attribute values include power and phoneme duration of each item of phoneme data, and in the first penalty assigning step, a power-related penalty is assigned in such a manner that a small penalty is assigned to phoneme data whose power is close to an average value of the power, and a phoneme-duration-related penalty is assigned in such a manner that a small penalty is assigned to phoneme data whose phoneme duration is close to an average value of the phoneme duration.

12. The method according to claim 11, wherein said storage step stores respective items of attribute information together with the plural items of phoneme data; and said first penalty assigning step obtains an attribute value from the attribute information stored at said storage step.

13. The method according to claim 12, wherein the attribute information includes phoneme label, phoneme boundary, fundamental frequency, power and phoneme duration.

14. The method according to claim 11, wherein said retrieval step retrieves phoneme data that satisfies a specified phoneme environment.

15. The method according to claim 11, wherein said retrieval step retrieves phoneme data that satisfies a specified phoneme environment and fundamental frequency.

16. The method according to claim 11, wherein said fist penalty assigning step sots retrieved phoneme data based upon a prescribed attribute value and assigns a penalty value on the basis of order obtained by sorting.

17. A speech synthesizing method comprising:

a storage step of storing plural items of phoneme data;

a retrieval step of retrieving phoneme data, in accordance with given search retrieval conditions, from the plural items of phoneme data stored at said storage step;

a first penalty assigning step of assigning a penalty that is based upon an attribute value to each item of phoneme data retrieved at said retrieval step where a penalty is assigned using power and phoneme duration of each item of phoneme data as the attribute value; and a selection step of selecting, from the phoneme data retrieved at said retrieval step, and based upon the penalty assigned at said penalty assigning step, phoneme data employed in synthesis of a speech waveform, wherein said first penalty assigning step:

sorts the items of phoneme data in order of decreasing power and assigns a power-related penalty on the basis of the order obtained by sorting, in such a manner that a small penalty is assigned to phoneme data whose power is close to an average value; and sorts the items of phoneme data in order of decreasing phoneme duration and assigns a phoneme-duration-related penalty on the basis of the order obtained by sorting, in such a manner that a small penalty is assigned to phoneme data whose phoneme duration is close to an average value.

18. A speech synthesizing method comprising:

a storage step of storing plural items of phoneme data;

a retrieval step of retrieving phoneme data, in accordance with given search retrieval conditions, from the plural items of phoneme data stored at said storage step;

a first penalty assigning step of assigning a penalty that is based upon an attribute value to each item of phoneme data retrieved at said retrieval step;

a selection step of selecting, from the phoneme data retrieved at said retrieval step, and based upon the penalty assigned at said penalty assigning step, phoneme data employed in synthesis of a speech waveform;

an alternate retrieval step of retrieving phoneme data that satisfied some of the retrieval conditions in a case where phoneme data that conforms to the retrieval conditions at said retrieval step does not exist;

a counting step of grouping phoneme data, which has been retrieved at said alternate retrieval step, on the basis on a phoneme environment, and counting the items of phoneme data on a per-group basis; and a second penalty assigning step of assigning a penalty on the basis of a count obtained at said counting step to the phoneme data retrieved at said alternate retrieval step, this penalty being assigned in addition to the penalty assigned at said first penalty assigning step.

19. The method according to claim 18, wherein the retrieval conditions include phoneme environment; and said alternate retrieval step retrieves phoneme data which agrees with part of a phoneme environment specified in the retrieval conditions.

20. The method according to claim 19, wherein the phoneme environment specified in the retrieval conditions is a triphone compose of an applicable phoneme and phonemes on both sides thereof; an said alternate retrieval means retrieves phoneme data for which the applicable phoneme and its left side phoneme agree with the retrieval conditions, or phoneme data for which the applicable phoneme and its right side phoneme agree with the retrieval conditions.

21. A storage medium storing a control program for causing a computer to execute speech synthesis using phoneme data, said control program having:

code of a storage step of storing plural items of phoneme data;

code of a retrieval step of retrieving phoneme data, in accordance with given search retrieval conditions, from the plural items of phoneme data stored at said storage step;

code of a first penalty assigning step of assigning a penalty that is based upon an attribute value to each item of phoneme data retrieved at said retrieval step; and code of a selection step of selection, from the phoneme data retrieved at said retrieval step, and based upon the penalty assigned at said first penalty assigning step, phoneme data employed in synthesis of a speech waveform, wherein the attribute values include power and phoneme duration of each item of phoneme data, and in the first penalty assigning step, a power-related penalty is assigned in such a manner that a small penalty is assigned to phoneme data whose power is close to an average value of the power, and a phoneme-duration-related penalty is assigned in such a manner that a small penalty is assigned to phoneme data whose phoneme duration is close to an average value of the phoneme duration.

22. A storage medium storing a control program for causing a computer to execute speech synthesis using phoneme data, said control program having:

code of a storage step of storing plural items of phoneme data;

code of a retrieval step of retrieving phoneme data, in accordance with given search retrieval conditions, from the plural items of phoneme data stored at said storage step;

code of a first penalty assigning step of assigning a penalty that is based upon an attribute value to each item of phoneme data retrieved at said retrieval step;

code of a selection step of selection, from the phoneme data retrieved at said retrieval step, and based upon the penalty assigned at said first penalty assigning step, phoneme data employed in synthesis of a speech waveform;

code of an alternate retrieval step of retrieving phoneme data that satisfies some of the conditions in a case where phoneme data that conforms to the retrieval conditions at said retrieval step does not exist;

code of a counting step of grouping phoneme data, which has been retrieved at said alternate retrieval step, on the basis of a phoneme environment, and counting the items of phoneme data on a per-group basis; and code of a second penalty assigning step of assigning a penalty on the basis of a count obtained at said counting step to the phoneme data retrieved at said alternate retrieval step, this penalty being assigned in addition to the penalty assigned at said first penalty assigning step.

23. A speech synthesizing apparatus comprising:

storage means for storing plural items of phoneme data, wherein each item of phoneme data includes an attribute value for phoneme environment, phoneme boundary and fundamental frequency, power and phoneme duration;

retrieval means for retrieving phoneme data from the plural items of phoneme data stored in said storage means;

penalty assigning means for sorting the phoneme data retrieved by said retrieving means based upon a prescribed attribute value and for assigning a penalty to each item of the phoneme data on the basis of order obtained by sorting so that larger penalty is added to the phoneme whose order is near the smallest and biggest and smaller penalty is added to the phonemes whose order is near the middle; and selection means for selecting, from the phoneme data retrieved by said retrieval means, and based upon the penalty assigned by said penalty assigning means, phoneme data to be employed in synthesis of a speech waveform.

24. A speech synthesizing method comprising:

a storage step of storing plural items of phoneme data, wherein each item of phoneme data includes an attribute value for phoneme environment, phoneme boundary and fundamental frequency, power and phoneme duration;

a retrieval step of retrieving phoneme data from the plural items of phoneme data stored at said storage step;

a penalty assigning step of sorting the phoneme data retrieved at said retrieving step based upon a prescribed attribute value and of assigning a penalty to each item of the phoneme data on the basis of order obtained by sorting so that larger penalty is added to the phoneme whose order is near the smallest and biggest and smaller penalty is added to the phoneme whose order is near the middle; and a selection step of selecting, from the phoneme data retrieved at said retrieval step, and based upon the penalty assigned at said penalty assigning step, phoneme data employed in synthesis of a speech waveform.

25. A storage medium storing a control program for causing a computer to execute speech synthesis using phoneme data, said control program having:

code of a storage step of storing plural items of phoneme data, wherein each item of phoneme data includes an attribute value for phoneme environment, phoneme boundary and fundamental frequency, power and phoneme duration;

code of a retrieval step of retrieving phoneme data from the plural items of phoneme data stored at said storage step;

code of a penalty assigning step of sorting the phoneme data retrieved at said retrieving step based upon a prescribed attribute value and of assigning a penalty to each item of the phoneme data on the basis of order obtained by sorting so that larger penalty is added to the phoneme whose order is near the smallest and biggest and smaller penalty is added to the phoneme whose order is near the middle; and code of a selection step of selecting, from the phoneme data retrieved at said retrieval step, and based upon the penalty assigned at said penalty assigning step, phoneme data employed in synthesis of a speech waveform.

* * * * *